US010914281B2

(12) United States Patent
Ghiaroni et al.

(10) Patent No.: US 10,914,281 B2
(45) Date of Patent: Feb. 9, 2021

(54) ROTARY HYDRAULIC MACHINE

(71) Applicant: ITALGROUP S.R.L. CON SOCIO UNICO

(72) Inventors: Luciano Ghiaroni, Castelfranco Emilia (IT); Marco Ghiaroni, Sorbara (IT)

(73) Assignee: ITALGROUP S.R.L. CON SOCIO UNICO, Castelfranco Emilia (IT)

( * ) Notice: Subject to any disclaimer, the term of this patent is extended or adjusted under 35 U.S.C. 154(b) by 0 days.

(21) Appl. No.: 16/298,658

(22) Filed: Mar. 11, 2019

(65) Prior Publication Data

US 2019/0277246 A1 Sep. 12, 2019

(30) Foreign Application Priority Data

Mar. 12, 2018 (IT) ..... 102018000003452

(51) Int. Cl.
*F03C 1/04* (2006.01)
*F03C 1/053* (2006.01)
(Continued)

(52) U.S. Cl.
CPC ..... *F03C 1/053* (2013.01); *F03C 1/0415* (2013.01); *F03C 1/0431* (2013.01);
(Continued)

(58) Field of Classification Search
CPC ..... F03C 1/053; F03C 1/0431; F03C 1/0415; F04B 1/0443; F04B 1/10; F04B 1/053; F04B 1/0448; F04B 1/0421
(Continued)

(56) References Cited

U.S. PATENT DOCUMENTS 3,489,421 A * 1/1970 Neilson ..... E21B 10/25 277/383
3,695,146 A * 10/1972 Orshansky, Jr. ..... F01B 1/0644 91/478
(Continued)

FOREIGN PATENT DOCUMENTS

DE 19626407 A1 1/1998
WO 2012014090 A1 2/2012
WO WO2012014090 * 2/2020 ..... F04B 1/0421

*Primary Examiner* — Dustin T Nguyen
(74) *Attorney, Agent, or Firm* — Pearne & Gordon LLP

(57) ABSTRACT

A rotary hydraulic machine with radial pistons comprising:
a rotating shaft (2);
a cylinder-housing body (3), having a plurality of housing seatings (4) arranged radially at equal distances from the rotation axis (R) of the rotating shaft (2);
a cylinder (5) housed in each of said plurality of housing seatings (4) and rotating relative to the same around an axis (C) concentric with said rotation axis (R) of the rotating shaft (2);
a piston (6) slidable in each cylinder (5) and coupled to a crank (7) of the rotating shaft (2);
a supply conduit (12), for each cylinder (5), provided with a seal (120) arranged to enable a sealed connection between the supply conduit (12) and the respective cylinder (5).
Each seal (120) comprises:
a first ring (121), arranged at an end of the supply conduit (12) and placed in contact with the cylinder (5);
a second ring (122), concentric to the first ring (121) and interposed between the supply conduit (12) and the first ring (121), wherein the second ring (122) is coupled by interference with the first ring (121) and is inserted by interference into the supply conduit (12) in such a way as to prevent a rotation of the first ring (121) with respect to the supply conduit (12) around a common axis (X).

10 Claims, 6 Drawing Sheets

(51) Int. Cl.

| | |
|---|---|
| ***F03C 1/32*** | (2006.01) |
| ***F04B 1/0421*** | (2020.01) |
| ***F04B 1/0448*** | (2020.01) |
| ***F04B 1/053*** | (2020.01) |
| ***F04B 1/10*** | (2006.01) |
| ***F04B 1/0443*** | (2020.01) |

(52) U.S. Cl.
CPC ..... *F04B 1/0421* (2013.01); *F04B 1/0443* (2013.01); *F04B 1/0448* (2013.01); *F04B 1/053* (2013.01); *F04B 1/10* (2013.01)

(58) Field of Classification Search
USPC ..... 92/148
See application file for complete search history.

(56) References Cited

U.S. PATENT DOCUMENTS

| | | | | |
|---|---|---|---|---|
| 4,683,806 | A * | 8/1987 | Ryzner | F02B 75/22 417/464 |
| 5,725,221 | A * | 3/1998 | Pekarsky | F16J 15/3208 277/589 |
| 2009/0301291 | A1 | 12/2009 | Pecorari et al. | |
| 2013/0064691 | A1 | 3/2013 | Pecorari | |
| 2013/0284014 | A1 | 10/2013 | Pecorari | |

* cited by examiner

ROTARY HYDRAULIC MACHINE

The present invention relates to a rotary hydraulic machine having radial pistons. In particular, the invention relates to a rotary hydraulic motor having radial pistons.

Rotary hydraulic motors with pistons are constituted by one or more chambers in which a volume is continually varied by the motion of a piston inside a cylindrical seating.

The chambers are placed periodically in fluid communication with the supply environment and with the discharging environment by means of apertures which are freed by the relative motion between the piston and the cylinder. In fact, a motor could also operate as a pump, considering that motors only substantially differ from pumps in the direction of the flow of energy, and not for their kinematic motion system.

In rotary hydraulic motors having radial pistons, to which the present invention relates, the pistons translate along axes which are arranged perpendicularly to the rotation axis of the drive shaft.

Rotary hydraulic motors with radial pistons are known which have a static cylinder block inside which a plurality of housing seatings for the cylinders are afforded. These seatings are arranged radially at equal distances (in a star fashion) with respect to the axis of the drive shaft.

The cylinders are constrained to the cylinder block by means of pins which enable the cylinders to oscillate in "pendulum fashion" about axes that are parallel to the drive shaft.

Respective pistons are arranged inside the cylinders and can slide along directions that are perpendicular to the drive shaft. The pistons are acting on a crank of the drive shaft, the crank rotating eccentrically with respect to the drive shaft.

When the chamber defined between the piston and the head of the respective cylinder is placed under pressure, the piston translates away from the cylinder head and transmits a force to the annular crown.

The crown transmits a force to the crank of the drive shaft directed perpendicularly to the rotation axis thereof. This force is clearly eccentric with respect to the rotation axis of the drive shaft, and thus generates a torque which sets the drive shaft in rotation. The combined action of the various cylinders guarantees a continuous rotary drive of the rotating shaft.

An example of a motor of the type described above is known from patent application MO2010A000216, also published as international application WO2012014090.

A supply conduit is provided for each cylinder, the supply conduit being equipped with a seal which serves to allow a sealed connection between the supply conduit and the respective cylinder. The seal comprises a main ring, located at one end of the supply conduit, and an o-ring, inserted on the main ring and interposed between the latter and the end of the supply conduit. The main ring can rotate about its own central axis with respect to the supply conduit, i.e. the main ring is not blocked in the supply conduit. This entails that the oscillation of the cylinders draws said main ring in alternating rotation, causing rapid wear of the o-ring. For this reason the motor must be stopped after short periods of operation to allow the replacement of the o-rings placed in the supplying conduits for supplying the cylinders.

In this context, the technical objective underpinning the present invention is to provide a rotary hydraulic machine having radial pistons which obviates the drawbacks in the prior art as cited herein above.

In particular, an aim of the present invention is to provide a rotary hydraulic machine having radial pistons which requires only small reconditioning operations.

A further aim of the present invention is to provide a rotary hydraulic machine with radial pistons which can be sized for any power.

Further characteristics and advantages of the present invention will more clearly emerge from the following non-limiting description of a preferred but not exclusive embodiment of a rotary hydraulic machine having radial pistons, as illustrated in the accompanying drawings, in which.

Figure 4:
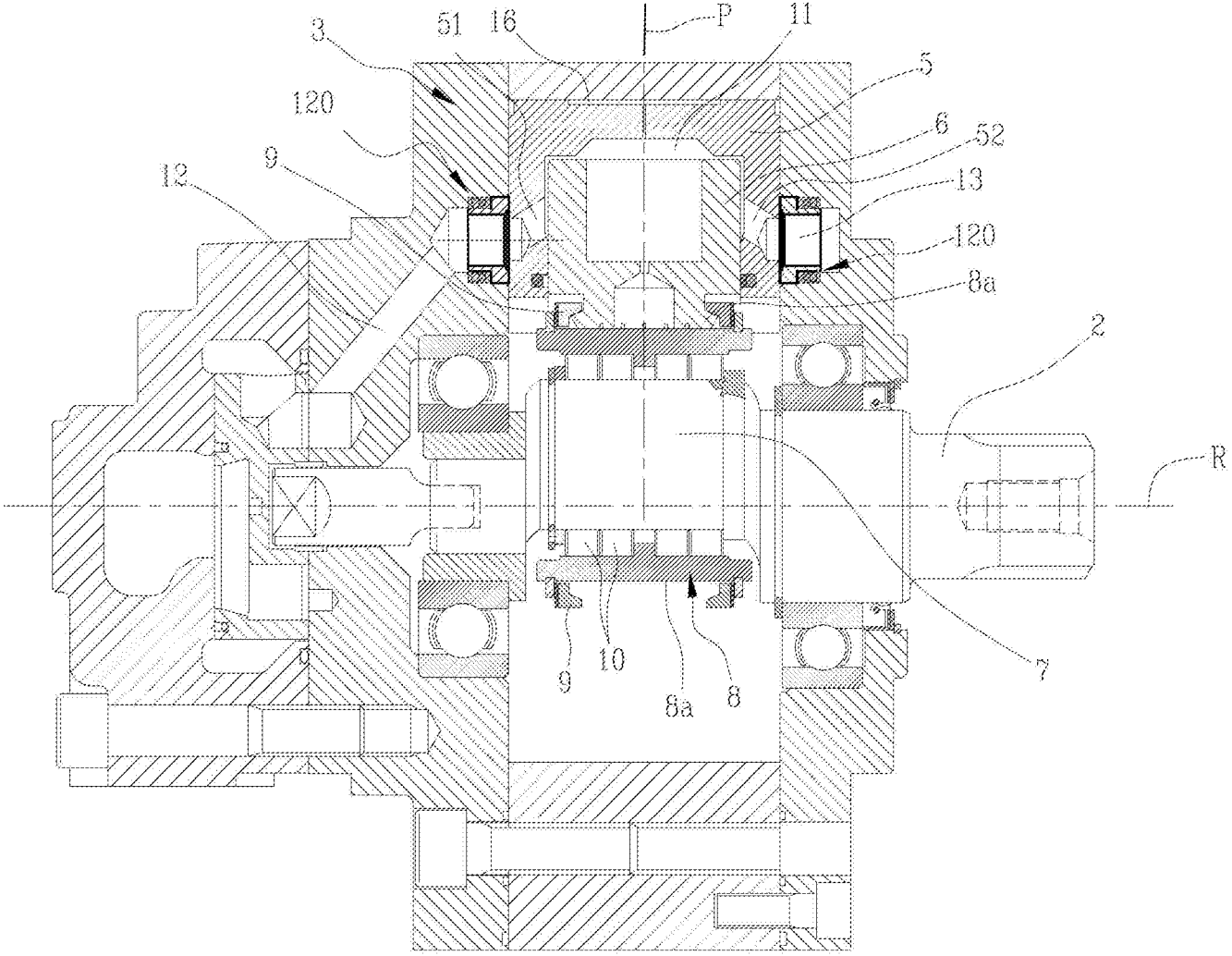
FIG. 4 is a section according to plane IV-IV of the machine of FIG. 1.
Figure 4A:
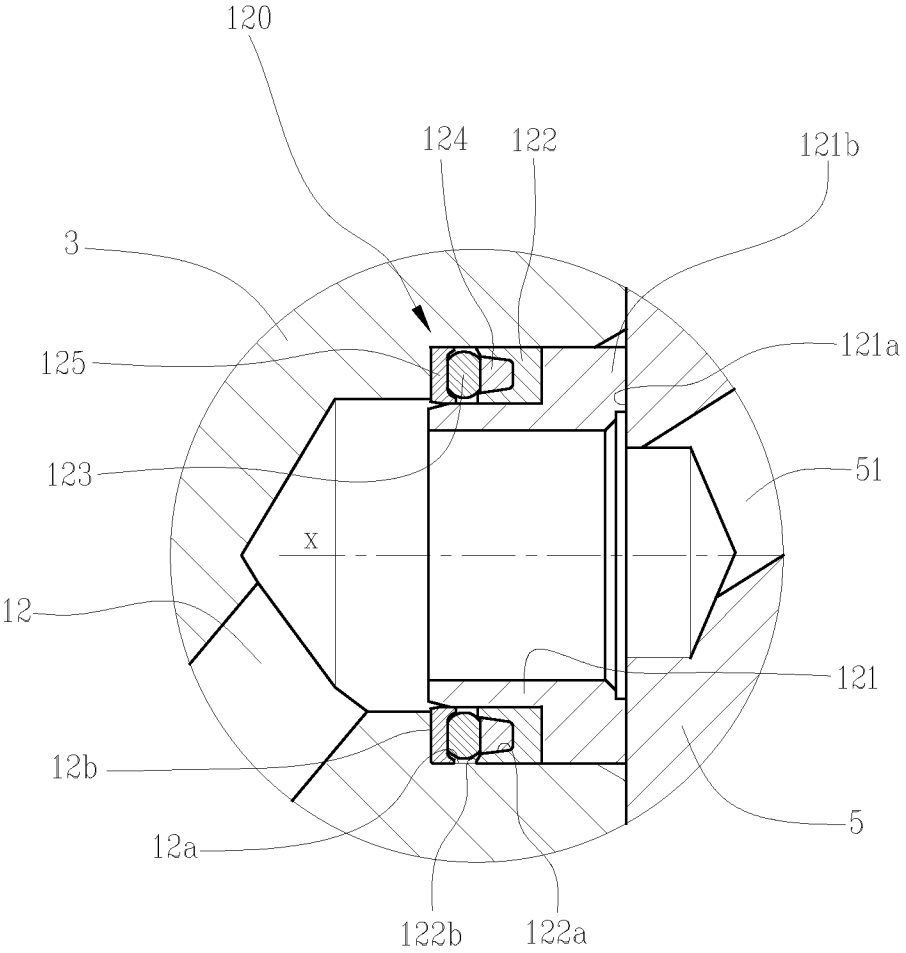

FIG. 4*a* is an enlargement of an area of FIG. 4*a;*

Figure 1:
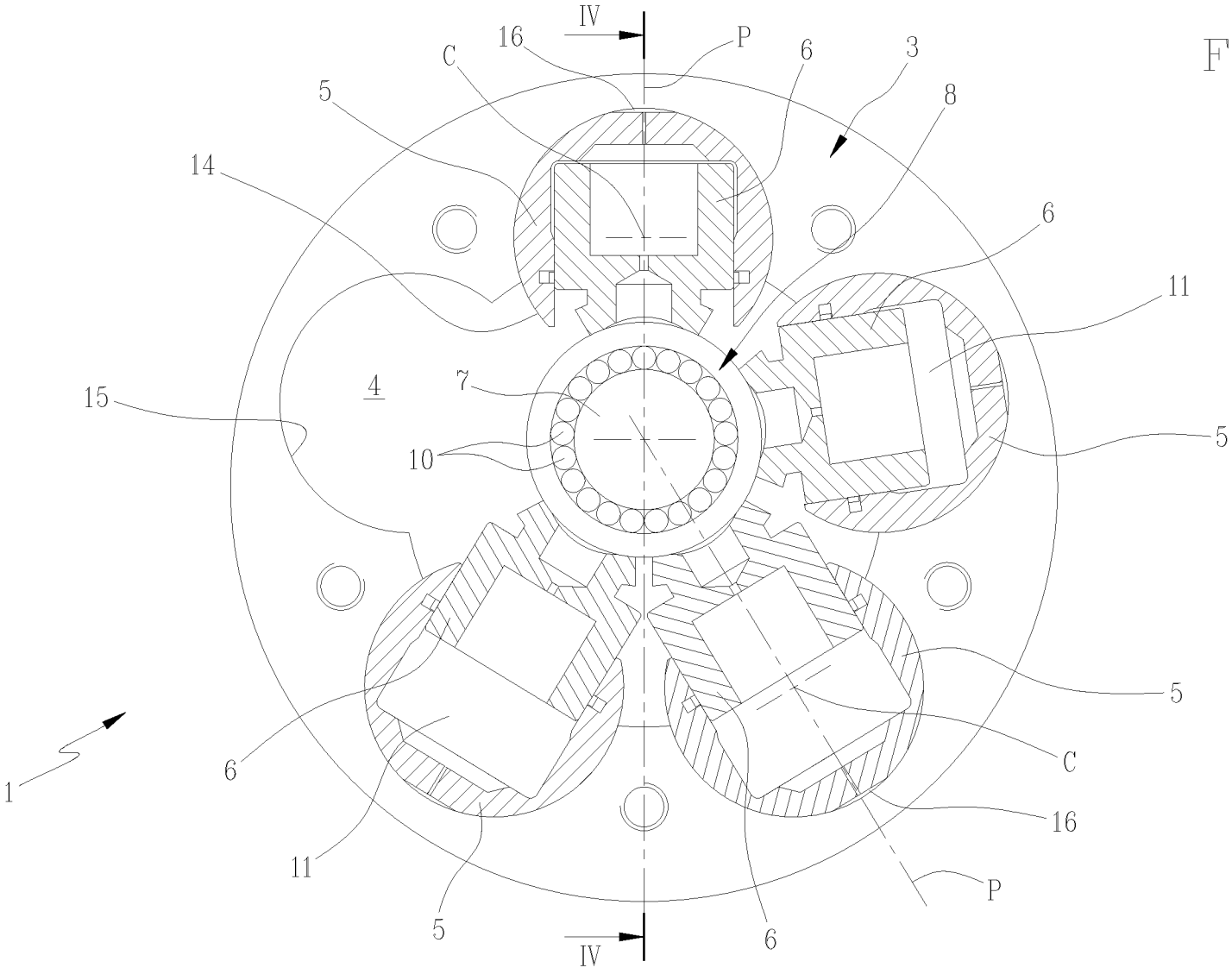
FIG. 1 is a section view of a rotary hydraulic machine having radial pistons of the present invention, with some parts removed better to evidence others.
Figure 5:
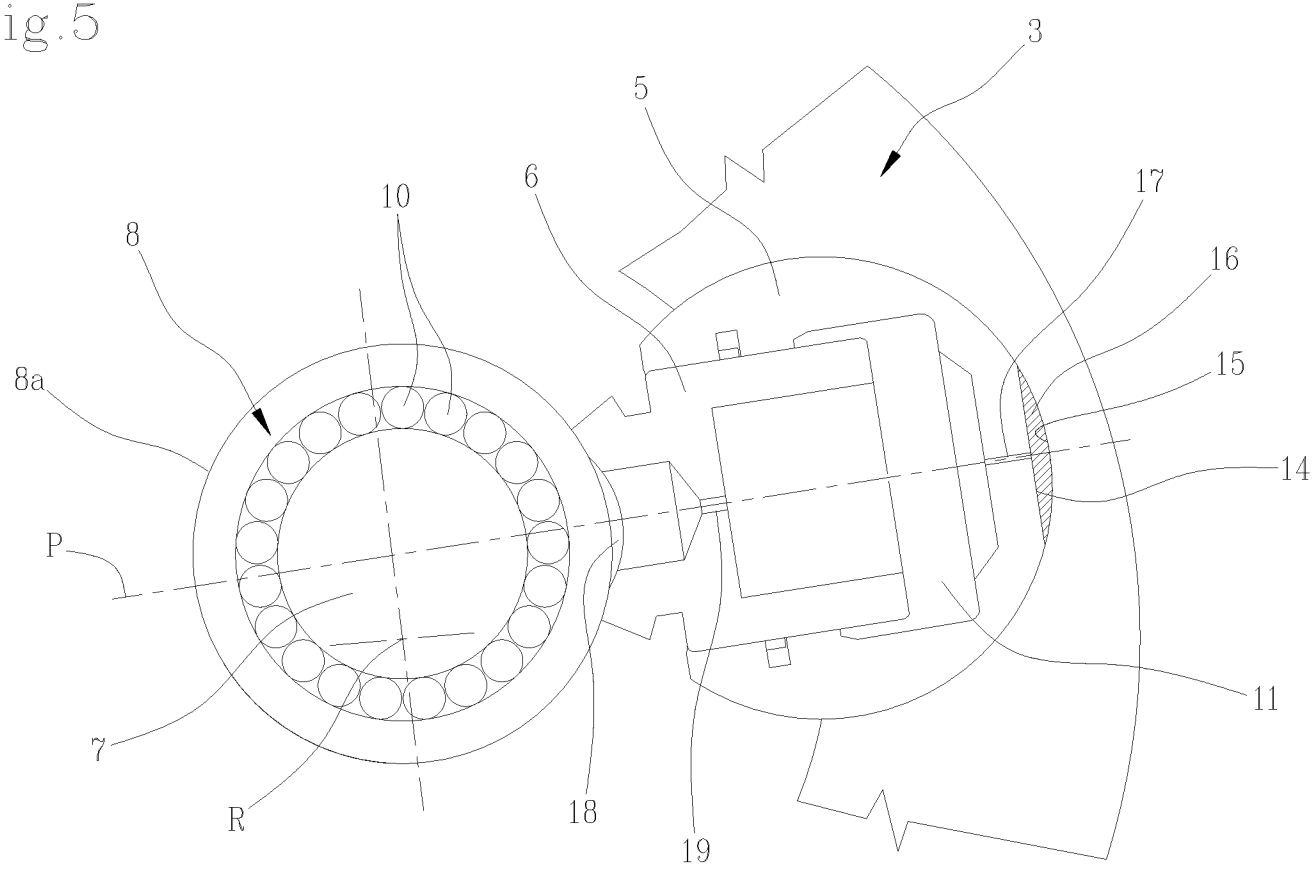

FIG. 5 is an enlarged view of a detail of the machine of FIG. 1.

With reference to the figures of the drawings, 1 denotes in its entirety a rotary hydraulic machine having radial pistons of the present invention.

The machine 1 comprises a rotating shaft 2 which, in the case of a motor, is a drive shaft and in the case of a pump is the shaft introducing energy into the pump.

The rotating shaft 2 rotates with a continuous motion about a rotation axis R (illustrated in FIG. 4).

The machine 1 further comprises a fixed cylinder-housing body 3 exhibiting a plurality of housing seatings 4.

The housing seatings 4 are arranged radially at equal distances to the axis R of rotation of the rotating shaft 2, such as to realise a star-configuration. In the preferred embodiment of the invention the housing seatings are five in number (see FIGS. 1, 2 and 3).

A relative cylinder 5 is provided inside each housing seating 4, which cylinder 5 is able to rotate inside the housing seating 4 about an axis C which is parallel to the rotation axis R of the rotating shaft 2.

A relative piston 6 is provided inside each cylinder 5. Each piston 6 is slidably coupled to the respective cylinder 5 along a sliding axis P (in the accompanying figures, and in particular in FIGS. 1, 2 and 3, a cylinder 5 and the respective piston 6 have been removed so that the housing seating 4 can be more clearly illustrated).

The sliding axes P are perpendicular to the rotation axis R of the rotating shaft 2 and perpendicular to the rotation axes C of the cylinder 5 inside the respective housing seatings 4.

Each piston 6 is further coupled to a crank 7 of the rotating shaft 2. The crank 7 is eccentric with respect to the rotation axis R of the rotating shaft 2 (see FIG. 4).

By crank, in the context of the present invention, reference is made to a portion of the rotating shaft 2 which develops in a "goose-neck" shape with respect to the rotating shaft, i.e. which forms a hook shape with respect to the straight development of the rotating shaft.

An annular crown 8 is fitted on the crank 7, which crown 8 is rotatable with respect to the crank about an axis that is parallel to the rotation axis R of the rotating shaft 2.

Each piston 6 is constrained to the annular crown 8 along a direction coinciding with the sliding axis P, while it is free to slide with respect to the annular crown 8 along a perpendicular direction to the sliding axis P.

In other words, each piston 6 cannot move away from the annular crown 8 but the crown 8 can rotate with respect to the piston 6.

For this purpose, the annular crown 8 comprises retaining members 9 which retain the base of the piston 6 on the external surface 8*a* of the annular crown 8 (as illustrated in FIG. 4).

Note that the retaining members 9 guarantee however that the base of the piston 6 can slide along the external surface of the annular crown 8.

The retaining members 9 are, for example, constituted by a pair of skids acting between the base of the piston 6 and the external surface 8*a* of the annular crown 8.

Rollers 10 (FIG. 4) are interposed between the annular crown 8 and the crank 7, which rollers 10 enable the annular crown 8 to rotate on the crank 7.

In this way, when a force is applied on the external surface of the annular crown 8 directed towards the centre thereof, this force generates a torque with respect to the rotation axis R of the rotating shaft 2 which causes rotation thereof.

To this end, note that the sliding axes P of the pistons 6 converge at a point coinciding with the centre of the annular crown 8 (and therefore eccentric with respect to the rotation axis R of the rotating shaft 2).

When the pressure increases in the expansion chamber 11 (the variable-volume chamber which is created between the piston head 6 and the cylinder 5), the piston 6 transmits a force to the annular crown 8 which sets the rotating shaft 2 in rotation (according to the kinematic motion system as described above).

In this regard one or more supply conduits 12 are enslaved to each cylinder 5 for the delivery of pressurised oil, and one or more discharge conduits 13 of the oil (see FIG. 4).

Each cylinder is provided with an inlet opening 51, placed in communication with a respective supply conduit 12. The supply conduit 12 is provided with a seal 120 arranged to enable a sealed connection between the supply conduit 12 and the respective cylinder 5. In the embodiment shown in FIG. 4, the seal 120 provides a connection between the supply conduit 12 and the inlet opening 51.

The seal 120 comprises a first ring 121, arranged at an end of the supply conduit 12 and placed in contact with the cylinder 5. In particular, the first ring 121 is placed in contact with an outer surface of the cylinder 5, concentrically with the inlet opening 51. The contact between the first ring 121 and the cylinder 5 takes place at a front surface 121*a* of said first ring 121.

The first ring 121 is inserted in a seating 12*a* afforded at one end of the supply conduit 12. A second ring 122 is interposed between the first ring 121 and the seating 12*a*. This second ring 122 is inserted concentrically on the first ring 121. The coupling between the first ring 121 and the second ring 122 is by interference. The coupling between the second ring 122 and the supply conduit 12 is also by interference. In substance, the second ring 122 is inserted by interference into the first ring 121 and is inserted by interference into the supply conduit 12. In the embodiment shown, the second ring 122 is inserted by interference into the seating 12*a* of the supply conduit 12.

As shown in FIG. 4A, the seating 12*a*, the first ring 121 and the second ring 122 are concentric with a common axis X. The interference between the couplings described above is such as to prevent a relative rotation between the first ring 121 and the seating 12*a* of the supply conduit 12, i.e. between the first ring 121 and the cylinder-housing body 3, around the common axis X, concentric with the first ring 121.

An o-ring or seal ring 123 is further interposed between the first ring 121 and the supply conduit 12. In the embodiment shown, the seal ring 123 is inserted on the first ring 121. In particular, the seal ring 123 is interposed between a front surface 122*b* of the second ring 122 and a shoulder 12*b* of the supply conduit 12 that delimits the seating 12*a*. These surfaces 122*b*,12*b* are arranged transversely with respect to the common axis X.

Thanks to the presence of the second ring 122 and the couplings by interference which prevent the rotation of the first ring 121 with respect to the seating 12*a* and the cylinder-housing body 3, the seal ring 123 is not subjected to any sliding, but is simply compressed between the second ring 122 and the seating 12*a*. This entails a considerable increase in the service life of the seal ring 123.

In the preferred but not exclusive embodiment shown, the first ring 121 comprises a radial widening 121*b* of the ends, facing the cylinder-housing body 3, delimited at the front by the front surface 121*a*. The second ring 122 is arranged at the side of the radial widening 121*b*, on the opposite side with respect to the cylinder-housing body 3. The radial widening 121*b* partially protrudes from the seating 12*a*.

To increase both the interference of the coupling between the second ring 122 and the first ring 121, and the interference of the coupling between the second ring 122 and the seating 12*a*, the second ring 122 is provided with a conical annular seating 122*a*, which widens in the direction of the seal ring 123. In the embodiment shown, the conical annular seating 122*a* opens onto the front surface 122*b* of the second ring 122, facing the seal ring 123.

The annular seating 122*a* houses a conical ring 124, whose taper is complementary to the taper of the annular seating 122*a*. Given the shape of the annular seating 122*a* of the conical ring 124, the application of a force directed parallel to the common axis X, which compresses the seal ring 123 against the second ring 122, tends to widen radially from the annular seating 122*a*, both toward the seating 12*a*, and toward the first ring 121. This involves an increase in the interference between the second ring 122 and, respectively, the seating 12*a* and the first ring 121.

The compression of the seal ring 123 can be achieved by forcing the first ring 121, inside the seating 12*a*, along the common axis X.

The seal 120 can be provided with a further abutment ring 125, placed in contact with a shoulder 12*b* of the supply conduit 12. This abutment ring 125 can be provided with an annular seating. The abutment ring 125 substantially serves as an abutment for the seal ring 123.

Both the abutment ring 125, and the conical ring 124, between which the seal ring 123 is tightly held, can be made of low-friction material, for example PTFE or POM, to further limit the wear of the seal ring 123.

Each cylinder is further provided with an outlet opening 52, placed in communication with a respective discharge conduit 13. The discharge conduit 13 is provided with a seal 120, analogous to the previously described seal 120, arranged to enable a sealed connection between the discharge conduit 13 and the respective cylinder 5, as shown in FIG. 4B. In the embodiment shown in FIG. 4B, the seal 120 provides a connection between the discharge conduit 13 and the outlet opening 52, in the same ways previously described in relation to the inlet opening 51.

Sending pressurised oil to a piston 6 produces the transmission of a force to the annular crown 8. The latter sets the crank 7 in motion and the piston 6 translates inside the cylinder 5.

Since, as mentioned, the sliding axis P of the pistons 6 passes through the centre of the annular crown 8 while the cylinders 5 are free to rotate inside the seatings 4 arranged at equal distances from the rotation axis R of the rotating shaft 2, the sliding of the piston 6 inside the cylinder 5 causes a rotation of the cylinder 5.

In other words, the pistons 6 near and moves away from the rotation axis R of the rotating shaft 2, while the cylinders 5 are always at the same distance from the rotation axis R.

Therefore, in order to have a sliding motion of the piston 6 inside the cylinder 5, the cylinder must be able to rotate inside the seating 4.

Figure 2:
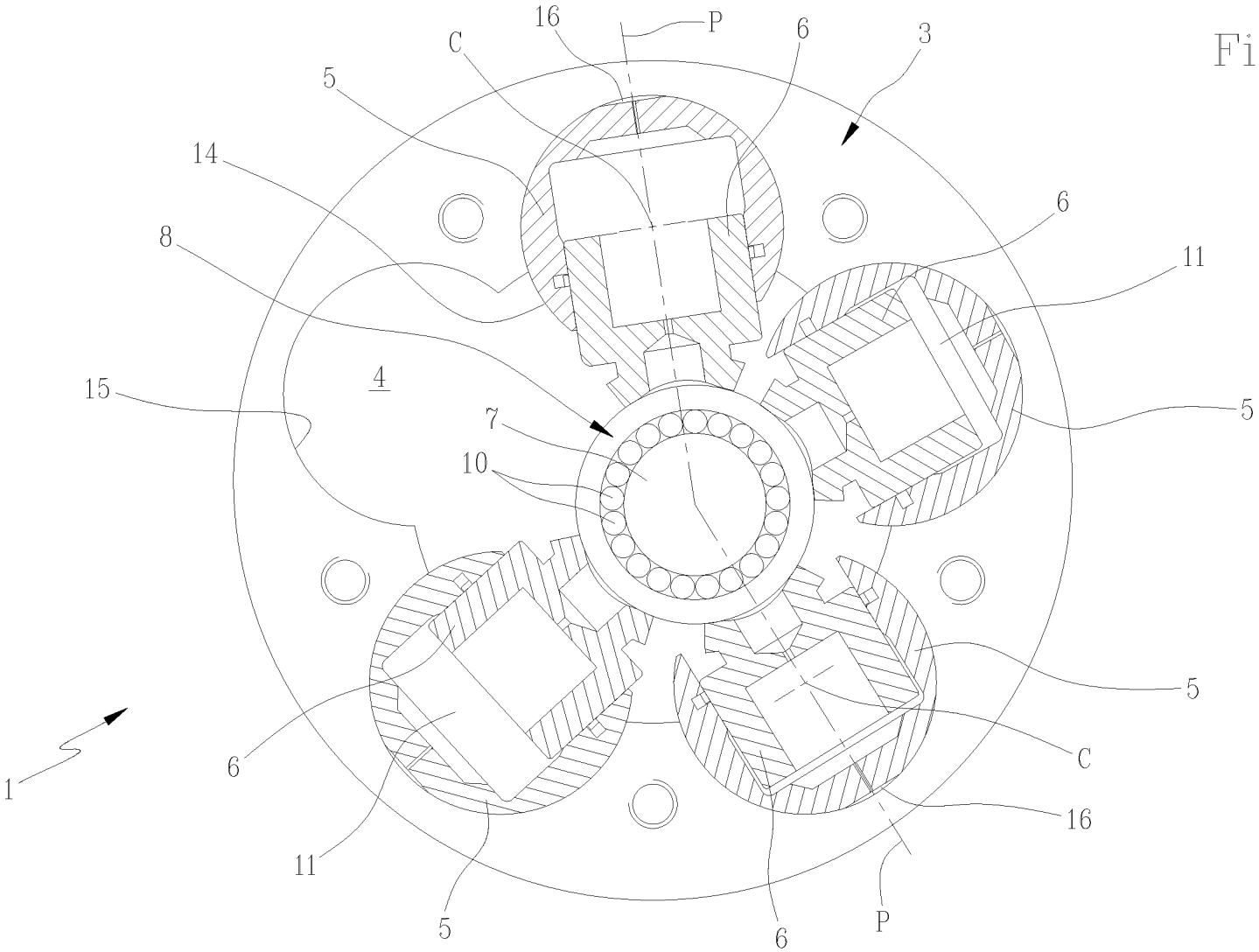
FIG. 2 is a view of the machine of FIG. 1 in a different operating configuration.
Figure 3:
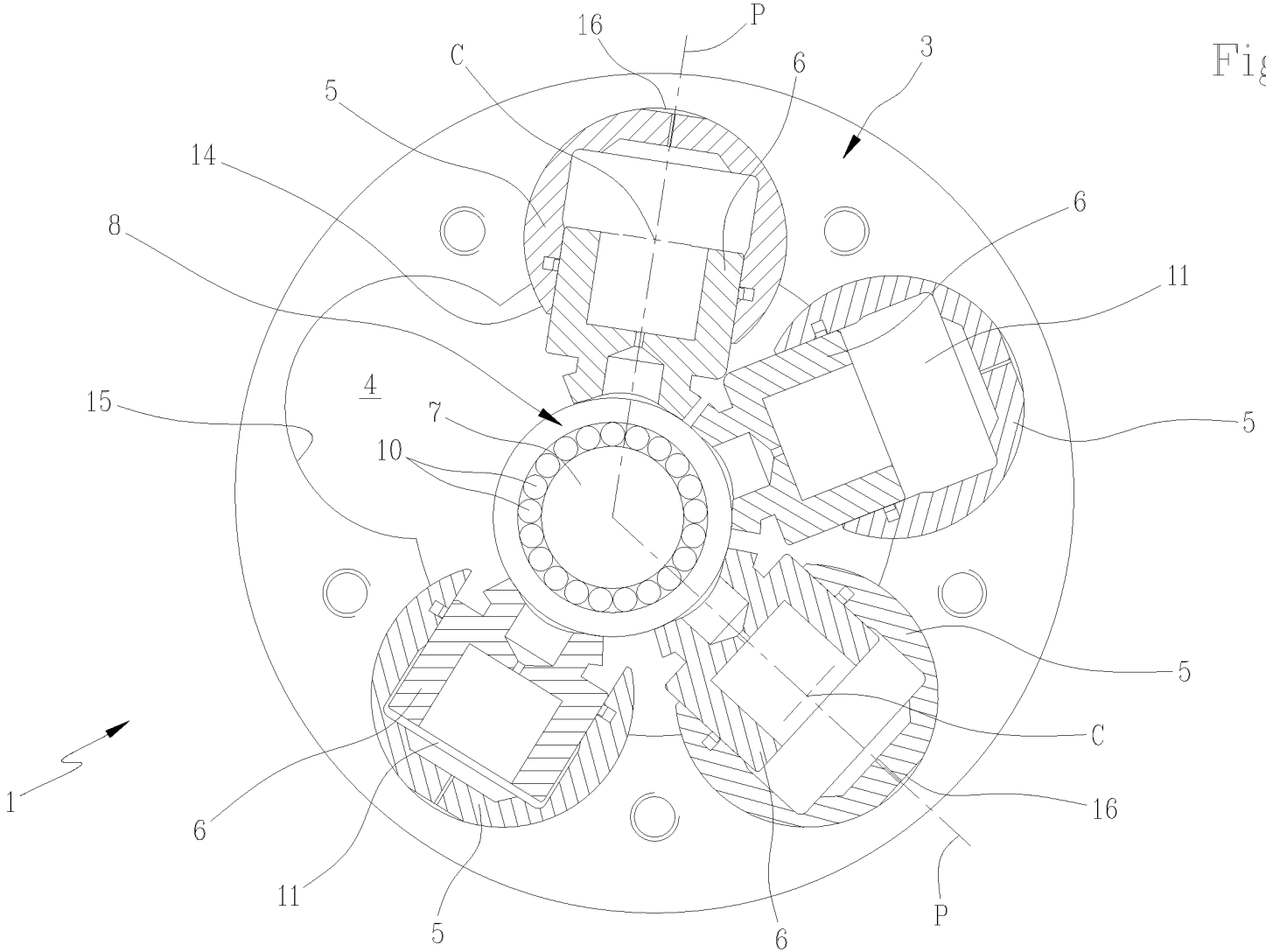
FIG. 3 is a view of the machine of FIG. 1 in a further different operating configuration.

By comparing FIGS. 1, 2 and 3 with one another, the entity of the rotation can be noted, as a function of the run of the piston 5 and thus of the translation of the crank 7.

In particular, between FIGS. 1 and 2 the crank 7 is translated, bringing it into a distanced position by 120° in a clockwise direction with respect to the original position thereof. The same type of motion differentiates FIG. 2 from FIG. 3 and FIG. 3 from FIG. 1.

As can be observed, the cylinders 5 perform a pendular oscillation during a complete revolution of the rotating shaft 2.

The rotation of the cylinders 5 is guaranteed by the coupling between the cylinder 5 and the respective housing seating 4.

In particular, the cylinders 5 and the housing seatings 4 have a cylindrical-sector conformation (see FIGS. 1, 2 and 3).

In detail, each cylinder 5 comprises an external wall 14 having a cylindrical-sector development and each housing seating 4 comprises a surface 15 having a cylindrical-sector development.

The external wall 14 of the cylinder 5 is slidably in contact with the surface 15 of the housing seating 4, i.e. it slides along the surface 15.

Note that there are no pins acting between the cylinder 5 and the respective housing seating 4 for to guaranteeing relative rotation between the two elements.

The surface 15 of the housing seating 4 and the external wall 14 of the cylinder 5 have a greater development than the development of a semi-cylinder (as illustrated in figures from 1 to 3).

In this way, the cylinder 5 is retained in the housing seating 4 by mechanical interference between the cylinder 5 and the seating 4.

The machine 1 advantageously comprises a compensating chamber 16, afforded between each cylinder 5 and the respective housing seating 4, set in fluid communication with a source of pressurised fluid (see in particular FIG. 5).

The compensating chamber 16 creates a thrust on the cylinder 5 which is able to compensate, at least in part, the thrust that is exerted on the cylinder during the run of the piston.

Note that the pressure inside the expansion chamber 11 generates a thrust on the piston 6 that is directed towards the centre of the annular crown 8 (as mentioned above) and, contemporaneously, generates a reaction force which is equal and opposite on the cylinder 5.

This force is the main one responsible for the friction forces which oppose the rotation of the cylinder 5 in the housing seating 4.

As mentioned herein above, the compensating chamber 16 enables a force to be generated on the cylinder 5 which is opposite the above-mentioned reaction force.

The compensating chamber 16 is preferably in fluid communication with the expansion chamber 11 such as to receive pressurised fluid directly from the expansion chamber 11.

This enables the same source of pressurised oil to be used for supplying both the expansion chamber 11 and the compensating chamber 16.

Further, as the pressure inside the expansion chamber 11 varies during the functioning of the machine, the pressure inside the compensating chamber 16 also varies in the same way.

In order to guarantee fluid communication between the expansion chamber 11 and the compensating chamber 16, the cylinder 5 comprises a conduit 17 which, by crossing the whole thickness of the chamber 5, connects the expansion chamber 11 and the compensating chamber 16.

In order to guarantee maximum efficiency of the compensating chamber 16, the chamber 16 is set in a position such that the sliding axis P of the piston 6 crosses the compensating chamber 16 (see FIG. 5).

The compensating chamber 16 preferably exhibits a maximum size at the sliding axis P of the piston 6.

In particular, the compensating chamber 16 is symmetrical with respect to the sliding axis P.

In this way, the efficiency of the compensating chamber 16 is maximised since the force transmitted to the cylinder 5 by the compensating chamber 16 is perfectly aligned with and in an opposite direction to the reaction force (see above) transmitted to the cylinder 5.

In the preferred embodiment of the invention, the compensating chamber 16 is defined by a rectified portion of the external wall 14 of the cylinder 5 in combination with the surface 15 of the housing seating 4 (as shown in FIG. 5).

In other words, the external wall 14 of the cylinder 5 exhibits a straight portion which, in combination with the curvature of the surface 15 of the housing seating 4, creates a space which defines the compensating chamber 16.

Note that the position of the compensating chamber 16 is fixed with respect to the cylinder 5 and varies with respect to the housing seating 4 as a function of the relative position of the cylinder inside the seating 4 (compare FIGS. 1, 2 and 3).

The machine 1 also comprises a further compensating chamber 18 acting between the piston 6 and the external surface 8*a* of the annular crown 8.

The further compensating chamber 18 performs the same function as the above-described compensating chamber 16, though it is acting between the base of the piston 6 and the annular crown 8.

In other words, the further compensating chamber 18 reduces the friction between the piston 6 and the annular crown 8.

The further compensating chamber 18 too is crossed by the sliding axis P of the piston 6 and exhibits a maximum size at the sliding axis P.

The further compensating chamber 18 is in fluid communication with the expansion chamber 11 via a conduit 19.

The invention thus attains the set aims.

The compensating chamber 16, in combination with the cylindrical-sector development of the housing seatings 4 and the cylinders 5 rotating therein, guarantee avoiding a concentration of forces at a few points (for example the pins in the prior art) and thus reduce wear on the machine and as a consequence limit the need for reconditioning operations.

The force transmitted to the cylinder by the piston 6 is in fact well distributed over a wide surface and is compensated (at least partially) by the compensating chamber 16.

Further, the compensating chamber 16, the housing seatings 4, the cylinders 5 and the pistons 6 can be sized as required without incurring any drawbacks, so that the machine 1 can be sized for any power rating.

The invention claimed is:

1. A rotary hydraulic machine comprising:

a rotating shaft;

a cylinder-housing body, having a plurality of housing seatings arranged radially at equal distances from a rotation axis of the rotating shaft;

a cylinder housed in each of said plurality of housing seatings and each cylinder rotating relative to its respective housing seating around an axis parallel with said rotation axis of the rotating shaft, wherein each cylinder and each housing seating has a cylindrical shape;

a piston slidable in each cylinder and coupled to a crank of the rotating shaft, said crank being eccentric with respect to the rotation axis of the rotating shaft;

a supply conduit for each cylinder, wherein a seal assembly is arranged to enable a sealed connection between each supply conduit and its respective cylinder;

each seal assembly comprising:

a first ring, a second ring, a seal ring, and a conical ring;

wherein each first ring is arranged at an end of its respective supply conduit and placed in contact with its respective cylinder;

wherein each second ring is concentric to its respective first ring and is interposed between its respective supply conduit and its respective first ring, wherein each second ring is coupled by interference with its respective first ring and is inserted by interference into its respective supply conduit in such a way as to prevent a rotation of its respective first ring with respect to its respective supply conduit around a common axis;

wherein each seal ring is interposed between its respective supply conduit and its respective first ring;

wherein each second ring comprises a conical annular seating, opening in the direction of its respective seal ring;

wherein each conical ring is inserted in the annular seating of its respective second ring;

and wherein each seal ring is interposed between its respective conical ring and a shoulder of its respective supply conduit.

2. The machine according to claim 1, wherein each seal assembly further comprises an abutment ring placed in contact with the shoulder of its respective supply conduit.

3. The machine according to claim 1, wherein each cylinder is provided with an inlet opening afforded on an external surface of its respective cylinder itself, and wherein each seal assembly is placed in contact with the external surface of its respective cylinder concentrically with its respective inlet opening.

4. The machine according to claim 1, further comprising a discharge conduit for each cylinder, wherein each discharge conduit is provided with a seal assembly arranged to enable a sealed connected between each discharge conduit and its respective cylinder.

5. The machine according to claim 1, further comprising a compensating chamber afforded between each cylinder and its respective housing seating, wherein each compensating chamber is in fluid communication with a source of pressurized fluid.

6. The machine according to claim 5, wherein each cylinder comprises an external wall having a cylindrical shape and each housing seating comprises a surface having a cylindrical shape, each external wall is slidably in contact with the surface of its respective housing seating; each compensating chamber is defined by a ground portion of said external wall of its respective cylinder in combination with said surface of its respective housing seating.

7. The machine according to claim 6, wherein each compensating chamber is in fluid communication with a respective expansion chamber that is defined between its respective piston and its respective cylinder, in order to receive pressurized fluid that is supplied to its respective expansion chamber.

8. The machine according to claim 1, further comprising an annular crown which is rotatably keyed on the crank of the rotating shaft; each piston being constrained to an external surface of said annular crown along a direction which coincides with a sliding axis of each respective piston.

9. The machine according to claim 8, further comprising a further compensating chamber acting between each respective piston and said external surface of the annular crown.

10. A rotary hydraulic machine comprising:

a rotating shaft;

a cylinder-housing body, having a plurality of housing seatings arranged radially at equal distances from a rotation axis of the rotating shaft;

a cylinder housed in each of said plurality of housing seatings and each cylinder rotating relative to its respective housing seating around an axis parallel with said rotation axis of the rotating shaft, wherein each cylinder and each housing seating has a cylindrical shape;

a piston slidable in each cylinder and coupled to a crank of the rotating shaft, said crank being eccentric with respect to the rotation axis of the rotating shaft;

a supply conduit for each cylinder, wherein a seal assembly is arranged to enable a sealed connection between each supply conduit and its respective cylinder;

each seal assembly comprising:

a first ring, a second ring, a seal ring, and an abutment ring;

wherein each first ring is arranged at an end of its respective supply conduit and placed in contact with its respective cylinder;

wherein each second ring is concentric to its respective first ring and is interposed between its respective supply conduit and its respective first ring, wherein each second ring is coupled by interference with its respective first ring and is inserted by interference into its respective supply conduit in such a way as to prevent a rotation of its respective first ring with respect to its respective supply conduit around a common axis;

wherein each seal ring is interposed between its respective supply conduit and its respective first ring;

and wherein each abutment ring is placed in contact with a shoulder of its respective supply conduit.

* * * * *